US011420103B2

(12) United States Patent
Burnett

(10) Patent No.: US 11,420,103 B2
(45) Date of Patent: Aug. 23, 2022

(54) SYSTEMS AND METHODS FOR PLAYING ENHANCED DISC GOLF

(71) Applicant: Clayton A. Burnett, Charleston, OR (US)

(72) Inventor: Clayton A. Burnett, Charleston, OR (US)

( * ) Notice: Subject to any disclaimer, the term of this patent is extended or adjusted under 35 U.S.C. 154(b) by 0 days.

(21) Appl. No.: 17/322,667

(22) Filed: May 17, 2021

(65) Prior Publication Data

US 2021/0354016 A1 Nov. 18, 2021

Related U.S. Application Data

(60) Provisional application No. 63/025,858, filed on May 15, 2020.

(51) Int. Cl.

| | |
|---|---|
| ***A63B 67/06*** | (2006.01) |
| ***A63F 9/04*** | (2006.01) |
| ***A63B 71/00*** | (2006.01) |
| ***A63B 63/08*** | (2006.01) |

(52) U.S. Cl.

CPC ..... *A63B 67/06* (2013.01); *A63B 63/08* (2013.01); *A63B 71/00* (2013.01); *A63F 9/04* (2013.01)

(58) Field of Classification Search

CPC ..... A63B 63/08; A63B 67/02; A63B 67/06; A63B 71/00; A63F 9/0413

See application file for complete search history.

(56) References Cited

U.S. PATENT DOCUMENTS

| | | | | |
|---|---|---|---|---|
| 4,743,026 | A * | 5/1988 | Eady | A63B 67/02 273/245 |
| 6,623,370 | B1 * | 9/2003 | Willer | A63B 67/02 473/157 |
| 7,402,115 | B2 * | 7/2008 | Moussa | A63F 9/0413 473/409 |
| 7,955,195 | B2 * | 6/2011 | Payer | A63B 67/002 473/410 |
| 2010/0279799 | A1 * | 11/2010 | Chapman | A63B 67/02 473/409 |

OTHER PUBLICATIONS

"Ript/Ript Revenge", "Gameception" blog post, https://scootergames.wordpress.com/2013/09/02/gameception/amp/, posted by Scooterb23 on Sep. 2, 2013 (Year: 2013).*

(Continued)

*Primary Examiner* — Laura Davison

(74) *Attorney, Agent, or Firm* — Porter, Wright, Morris & Arthur, LLP

(57) ABSTRACT

A method for playing disc golf on a course having a plurality of targets includes the steps of (a) obtaining a random selection device configured to randomly select one of a plurality of different types of throws, and one of a plurality of different types of discs, (b) the player activates the random selection device to obtain a randomly selected throw, and a randomly selected disc, and (c) the player throws the randomly selected disc with the randomly selected throw at the target. The steps are repeated for each target until the course is completed. The random selection device can be a set of dice.

17 Claims, 5 Drawing Sheets

(56) References Cited

OTHER PUBLICATIONS

Reddit thread, "ript revenge, the best game ever, card game slash disc golf skins, it might make you hate your friends", https://www.reddit.com/r/discgolf/comments/hu8sk/ript_revenge_the_best_game_ever_card_game_slash/, see comment by H8rade on Jun. 8, 2011 (Year: 2011).*

Wikipedia, "Disc golf", https://en.wikipedia.org/wiki/Disc_golf, archived by the Internet Archive on Mar. 3, 2019 (Year: 2019).*

Dice Game Depot, "Dice Sizes", https://www.dicegamedepot.com/dice-sizes/, archived by the Internet Archive on Mar. 14, 2015 (Year: 2015).*

SDG Golf, "Standard Mischief Spinners", http://www.sgdgolf.com/min-golf-course-accessories/games/mischief-spinners.html, archived by the Internet Archive on Sep. 30, 2016 (Year: 2016).*

* cited by examiner

SYSTEMS AND METHODS FOR PLAYING ENHANCED DISC GOLF

CROSS-REFERENCE TO RELATED APPLICATIONS

This application claims the priority benefit of U.S. provisional patent application No. 63/025,858 filed on May 15, 2021, the disclosure of which is expressly incorporated herein in its entirety by reference.

STATEMENT REGARDING FEDERALLY SPONSORED RESEARCH

Not applicable

PARTIES TO A JOINT RESEARCH AGREEMENT

Not Applicable

REFERENCE TO APPENDIX

Not applicable

FIELD OF THE INVENTION

The field of the present invention generally relates to disc golf, and more particularly, to systems and methods for enhancing disc golf.

BACKGROUND OF THE INVENTION

Disc golf is a sport in which players 7 throw a flying disc 8 at a target 9. The targets are typically baskets into which the discs are thrown (see FIGS. 1 and 2). Disc golf is played using rules similar to golf. Disc golf is usually played on a course typically with nine or eighteen "holes" or targets or 9 along a course but there can be any other number of holes targets 9. Players 7 complete a target 9 by throwing a disc 8 from a tee area toward the target 9, throwing the disc 8 again from where the previous throw landed, until the target 9 is reached. Usually, the number of throws a player 7 uses to reach each target 9 is tallied (often in relation to par for the particular hole), and players seek to complete the course in the lowest number of total throws. The player with the lowest number of total throws is the winner Discs for disc golf are much smaller and much heavier than "Ultimate" type flying discs and general purpose recreational "Frisbees". Disc-golf discs are designed and shaped for control, speed, and accuracy, while general-purpose flying discs have a more traditional shape, similar to a catch disc. Disc-golf players typically use a variety of different types of discs each having a unique flight characteristic for use in different situations. This is similar to golf, where players use a variety of different types of golf clubs to obtain desired paths and distances for struck golf balls.

While disc golf is a popular and growing sport, advanced players can become somewhat bored over time, particularly when playing the same course over and over again. Particularly if the course does not have a high level of difficulty. Accordingly, there is a need for systems and methods for enhancing disc golf.

SUMMARY OF THE INVENTION

The present invention provides systems and methods for enhancing disc golf which addresses at least one of the above-noted problems of the prior art. Disclosed herein is method for at least one player playing disc golf on a course having a plurality of targets. The method comprising the steps of, in combination: (a) obtaining a random selection device configured to randomly select one of a plurality of different types of disc throws, and one of a plurality of different types of throwing discs; (b) the at least one player activating the random selection device to obtain a randomly selected one of the plurality of different types of disc throws, and a randomly selected one of the plurality of a plurality of different types of throwing discs; and (c) the at least one player throwing the randomly selected one of the plurality of different types of discs with the randomly selected of the plurality of different disc throws at least one target.

Also disclosed herein is a system for playing disc golf comprising, in combination, a set of dice including a first die and a second die; wherein the first die and the second die each have a plurality of face. The plurality of faces of the first die have representations indicating different types of disc throws thereon. The plurality of faces of the second die have representations indicating different types of throwing discs thereon.

From the foregoing disclosure and the following more detailed description of various preferred embodiments it will be apparent to those skilled in the art that the present invention provides a significant advance in the technology and art of disc golf. Particularly, significant in this regard is the potential the invention affords for making disc golf less predictable and more challenging, and for improving throwing skills of the players. Additional features and advantages of the invention will be better understood in view of the detailed description provided below.

BRIEF DESCRIPTION OF THE DRAWINGS

These and further objects of the invention will become apparent from the following detailed description.

Figure 1:
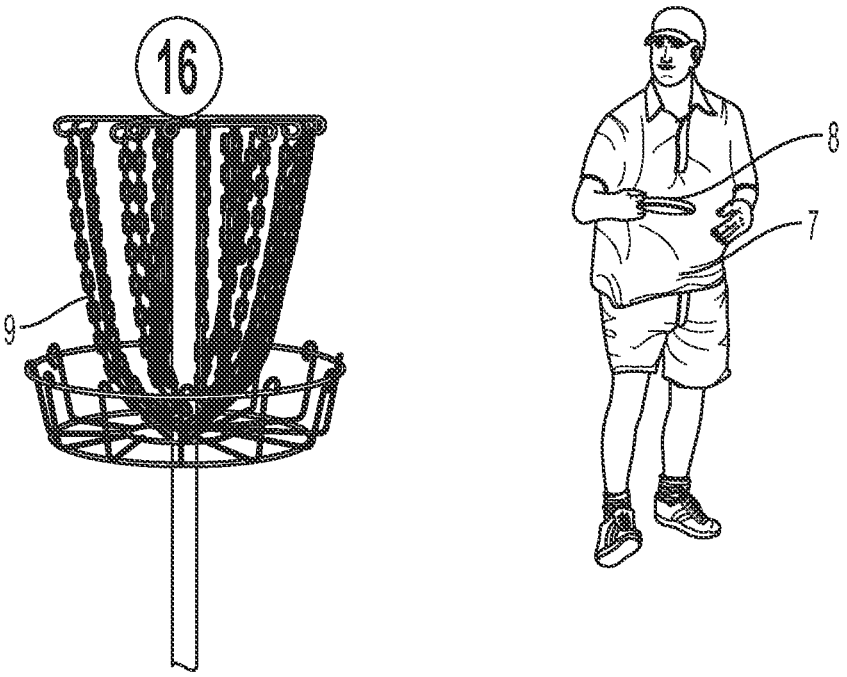
FIG. 1 PRIOR ART
FIG. 1 shows a disc golf player throwing a golf disc towards a target.
Figure 2:
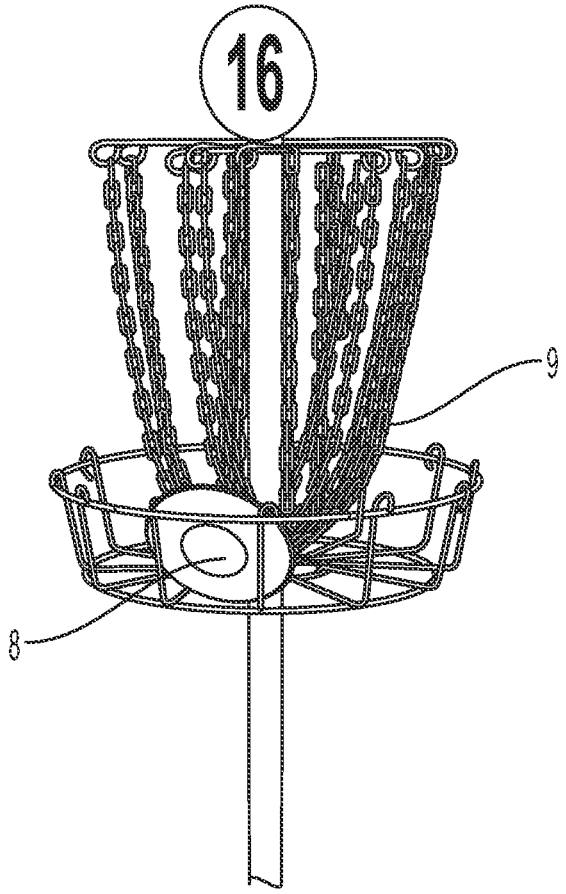
FIG. 2 PRIOR ART
FIG. 2 shows a golf disc that has successfully landed with a target.

It should be understood that the appended drawings are not necessarily to scale, presenting a somewhat simplified representation of various preferred features illustrative of the basic principles of the invention. The specific design features of the various components of the disc golf system as disclosed herein, including, for example, specific dimensions, orientations, locations, and shapes will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the components illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the systems and methods disclosed herein. The following detailed discussion of various alternative and preferred embodiments will illustrate the general principles of the invention with regard to the specific application. Other embodiments suitable for other applications will be apparent to those skilled in the art given the benefit of this disclosure.

Figure 3:
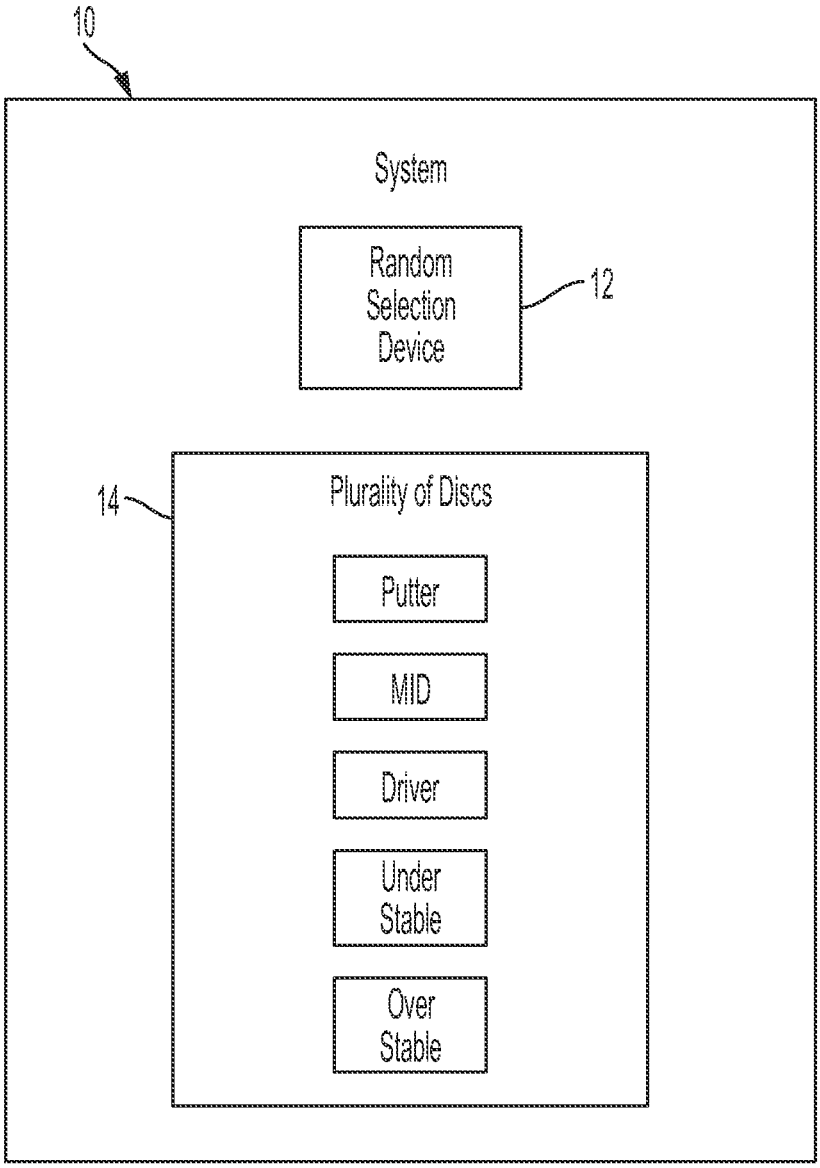
FIG. 3 schematically illustrates a system for enhancing disc golf according to the present invention.

FIG. 3 illustrates a system 10 for enhancing disc golf according to the present invention. The illustrated system includes a random selection device 12 configured to randomly select one of a plurality of different types of golf disc throws, and one of a plurality of different types of golf throwing discs. The illustrated system 10 also includes the plurality of different types of golf throwing discs 14 that may be randomly selected by the random selection device 12.

Figure 4:
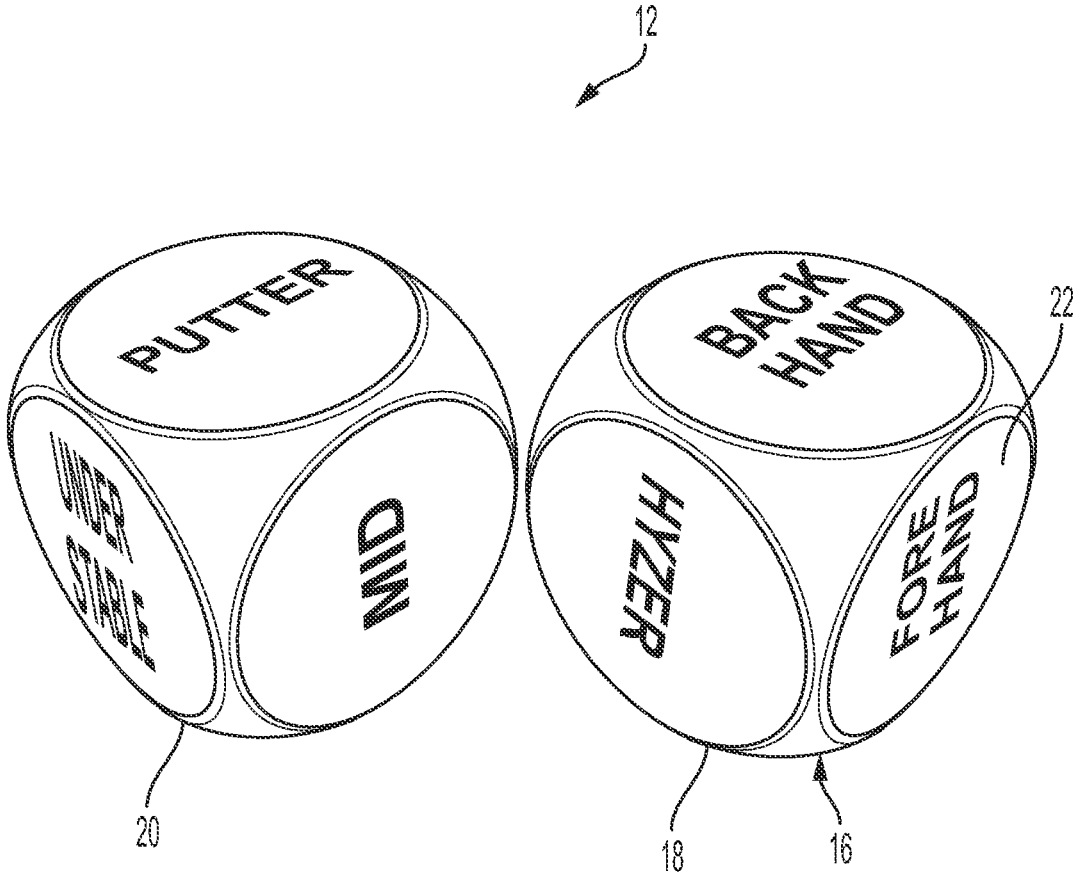
FIG. 4 shows a random selection device of the system of FIG. 3 in the form of a set of dice.
Figure 5A:
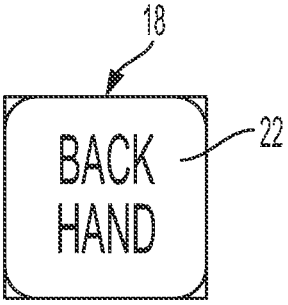
FIG. 5A shows a top face of a first die of the set of dice of FIG. 4.
Figure 5B:
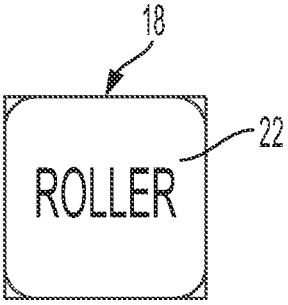
FIG. 5B shows a bottom face of the first die of FIG. 5A.
Figure 5C:
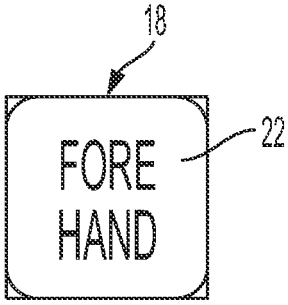
FIG. 5C shows a front face of the first die of FIGS. 5A and 5B.
Figure 5D:
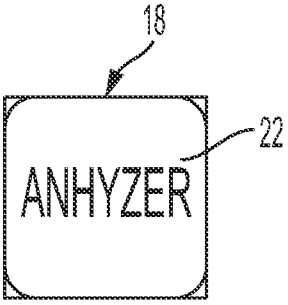
FIG. 5D shows a rear face of the first die of FIGS. 5A to 5C.
Figure 5E:
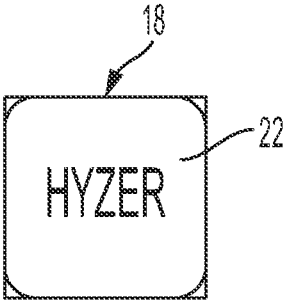
FIG. 5E shows a right face of the first die of FIGS. 5A to 5D.
Figure 5F:
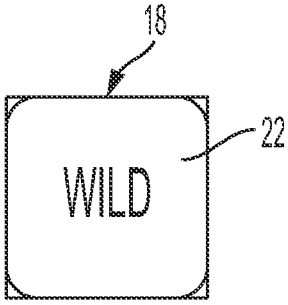
FIG. 5F shows a left face of the first die of FIGS. 5A to 5E.
Figure 6A:
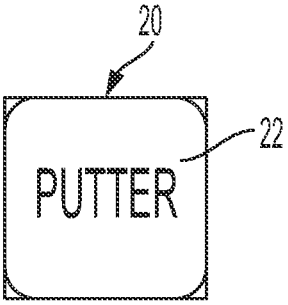
FIG. 6A shows a top face of a second die of the set of dice of FIG. 4.
Figure 6B:
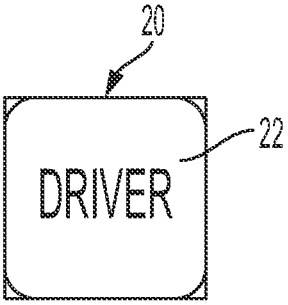
FIG. 6B shows a bottom face of the second die of FIG. 6A.
Figure 6C:
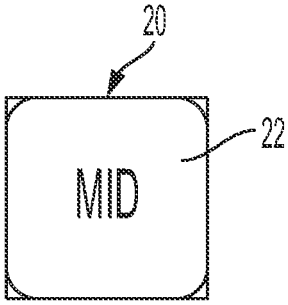
FIG. 6C shows a front face of the second die of FIGS. 6A and 6B.
Figure 6D:
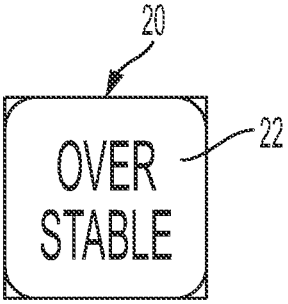
FIG. 6D shows a rear face of the second die of FIGS. 6A to 6C.
Figure 6E:
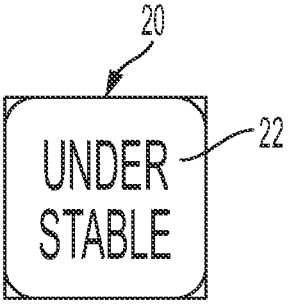
FIG. 6E shows a right face of the second die of FIGS. 6A to 6D.
Figure 6F:
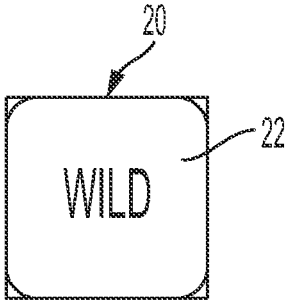
FIG. 6F shows a left face of the second die of FIGS. 6A to 6E
Figure 7A:
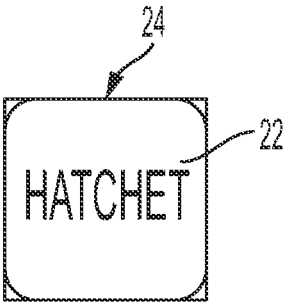
FIG. 7A shows a top face of a third die according to a variation of the set of dice of FIG. 4.
Figure 7B:
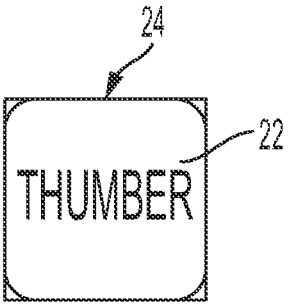
FIG. 7B shows a bottom face of the third die of FIG. 7A.
Figure 7C:
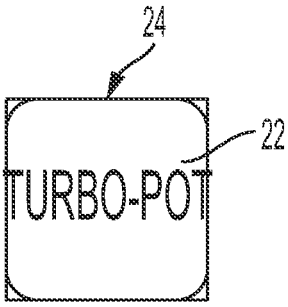
FIG. 7C shows a front face of the third die of FIGS. 7A and 7B.
Figure 7D:
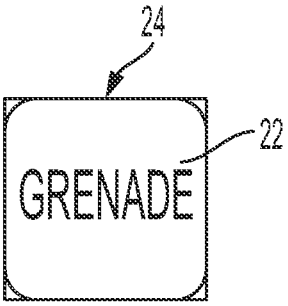
FIG. 7D shows a rear face of the third die of FIGS. 7A to 7C.
Figure 7E:
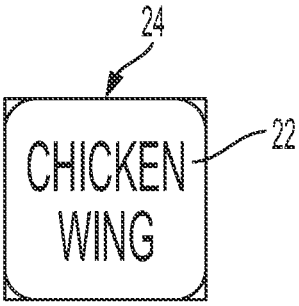
FIG. 7E shows a right face of the third die of FIGS. 7A to 7D.
Figure 7F:
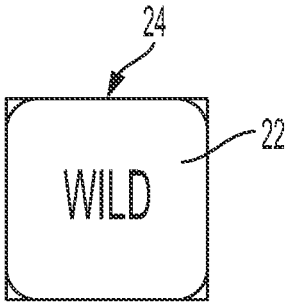
FIG. 7F shows a left face of the third die of FIGS. 7A to 7E.

As best shown in FIG. 4, the random selection device 12 can be a set of dice 16 including a first die 18 and a second die 20 with each of the first die 18 and the second die 20 having at least six sides or faces 22. Each of the illustrated faces 22 is square shaped and planar or flat but it is noted that the faces can alternatively have any other suitable shape. It is also noted that one or both of the first die 18 and the second die 20 can alternatively have more than six sides or faces if desired and/or alternatively have any other suitable configuration. It is further noted that the random selection device 12 can alternatively take other forms such as, for example but not limited to, a unique stand-alone electronic device, or an app operational on an electronic device such as a smart phone, tablet, or the like.

As best shown in FIGS. 5A to 5F, the faces 22 of the first die 18 has representations indicating different types or choices of golf disc throws or shots thereon. The illustrated first die 18 has words indicating the following golf disc throws or shot types: Backhand; Forehand; Roller; Hyzer; Anhyzer; and Wild (or player's choice). It is noted that any other words or graphical representations can alternatively be utilized to indicate these golf disc throws or shot types. It is also noted that any other suitable group of golf disc throws or shot types can alternatively be utilized. To perform a backhand throw, the golf disc is rapidly drawn from across the front of the body, and released towards a forward aim point. Due to the potential snap available with this technique, one can expect greater distance than with a forehand throw. It is important to initiate momentum from the feet and allow it to travel up the body, hips and shoulders, culminating in the transfer of energy to the disc. A forehand (or sidearm) throw is performed by drawing the disc from behind and partially across the front of the body: similar to a sidearm throw in baseball. The term sidearm actually predates the term forehand, which is seemingly in use today as a simpler means to communicate the technique, equating to a tennis forehand. A Roller is thrown either backhand or forehand and the disc will predominately be in contact with the ground. The disc remains in motion while travelling on its edge at a slight angle, and can travel exceedingly far in ideal situations. Once perfected, the Roller is an invaluably versatile tool in the disc golfer's arsenal. A Hyzer has an angle of release where the outside edge or left edge of the disc is tilted downward for a RHBH thrower. An Anhyzer has an angle of release where the outside edge or left edge of the disc is tilted upward for a RHBH thrower. The Hyzer and Anhyzer are throws designed to take advantage of the natural angle of the disc. For example, if you have a tree blocking your approach to the basket, you can use the Hyzer type of throw and angle the disc further down (toward the left for right handed players) to generate a harder angled turn.

As best shown in FIGS. 6A to 6F, the sides or faces 22 of the second die 20 has representations indicating types or choices of different golf throwing discs thereon. The illustrated second die has words indicating the following disc types: Putter; Mid (or Mid-Range), Driver, Understable (or Under/Stable), Overstable (or Over/Stable), and Wild (or Player's Choice). It is noted that any other words or graphical representations can alternatively be utilized to indicate these disc types. It is also noted that any other suitable group of disc types can alternatively be utilized. Putters are similar to the discs used in simple games of catch, such as the Wham-O brand Frisbee. They are designed to fly straight, predictably, and very slowly compared to mid-range discs and drivers. They are typically used for tight, controlled shots that are close to the basket, although some players use them for short drives where trees or other obstacles come into play. Mid-range discs feature a dull, beveled edge and a moderate rim width. They offer more control than drivers, but they have a smaller range. Mid-range discs are typically used as approach discs. Drivers are recognized by their sharp, beveled edge and have most of their mass concentrated on the outer rim of the disc rather than distributed equally throughout. They are optimized for aerodynamics and designed to travel maximum distances at high speeds. They are typically thrown by experienced players during tee-off and other long distance fairway throws. Understable discs have the tendency to turn to the right during the high speed portion of the flight for a RHBH thrower. The faster the disc is thrown, the more it will turn. Therefore, an understable disc will turnover more upwind than downwind. Overstable discs have the tendency to turn to the left at high or low speeds for a RHBH thrower. The Wild (or player's choice) roll enables the player to select any disc in their arsenal but it should be a disc that would not be typically used for that particular shot.

The set of dice 16 can also include one or more additional die if desired to be used as substitutes for one or both of the first and second dies 18, 20 described above. For example, a third die 24 can be provided with the faces 22 having representations indicating different more advanced or additional types of golf disc throws or shots or throw choices thereon. The illustrated third die would be selectively used in place of the illustrated first die 18. The third die 24 could have words indicating the following additional throw or shot types: Hatchet (or Tomahawk); Thumber (or U.D.); Turbo-Putt; Grenade (or Baseball); Chicken-Wing (or Overhand Wristflip); and Wild (or player's choice). It is noted that any other words or graphical representations can alternatively be utilized to indicate these throw or shot types. It is also noted that any other suitable group of golf disc throws or shot types can alternatively be utilized. The Hatchet (or Tomahawk) is gripped similarly to the sidearm toss but thrown with an overhand motion. The disc orientation nearly perpendicular to the ground over much of the flight. The Thumber (or U.D.) is thrown in an overhand manner but with thumb held on the disc's underside. The Turbo-Putt is thrown with a putter when the player holds the disc upright, supported in the middle by the thumb, with the finger tips outside of the edge, somewhat like a waiter holding a platter. The player stands with the leg opposite from the throwing arm forward, reaches back, and then extends their arm towards the basket, throwing the disc in a motion similar to that of throwing a dart. Ideally the thrower does not rotate his wrist; the act of following through will give the disc its spin. The Grenade (or Baseball) is thrown as in the backhand, but with the disc upside-down. This shot is used oiler to get up and down on a short shot where there is danger of a shot rolling away or going out of bounds if thrown too far. The Chicken-Wing (or Overhand Wristflip) is a very difficult and stylized throw and is thrown in the same manner the "Baseball" but drawn on the sidearm side of the body, and by inverting the arm and disc. Using the thumb as the power finger, the disc is drawn from the thigh area rearwards and up from behind the body to over the shoulder, releasing toward a forward aim point. The disc flies in a conventional flight pattern. The wild (or player's choice) roll enables the play to select any "wild" shot of their choosing such as, for example but not limited to, behind the back, through the legs, and the like.

Each die 18, 20, 24 of the exemplary sets of dice 16 is a cube having six square faces 22 but any other suitable shape can alternatively be utilized. Each die 18, 20, 24 preferably has a size that is larger than a standard die (16 mm across each face), and more preferably has a size that is about 50% larger than a standard die (16 mm across each face) such as about 22 mm to 26 mm across each face 22. The illustrated sets of dice have a size of about 22 mm across each face. The dice 18, 20, 22 can comprise any suitable material such as, but not limited to, a thermoset plastic (for example polymethyl methacrylate (PMMA)), a cellulose based plastic, and the like. Any desired colorant can be added to make the dice visually appealing. The dice 18, 20, 24 can be manufactured by any suitable process such as, for example but not limited to, injection molding and the like. The indicia can be added and/or highlighted by any suitable process such as, for example but not limited to, painting, printing, coatings, stickers, and the like.

The illustrated system 10 can also include a plurality of golf throwing discs 14. Preferably, the plurality of discs 14 includes at least one of each of the different types of golf throwing discs indicated on the faces 22 of the second die 20. It is noted however, that that there can be more than one of some types of golf throwing disc types, particularly drivers and putters. It is also noted that there can be fewer or more than all of the disc types indicated on the second die 20.

An exemplary method for playing enhanced disc golf according to the present invention is now described. Each player begins by first using the random selection device 12 to determine a throw or shot type and a disc type that is to be used by that player. In the illustrated embodiment, each player throws the set of dice 16 to randomly determine a throw or shot type and a disc type. The player then throws the randomly selected disc with the randomly selected throw or shot from the tee, without crossing over the front of the tee prior to releasing the disc. Crossing over the front of the tee, not using the correct throw or shot type, or using the incorrect disc could lead to a fault. Each players then navigates the hole or target by picking up the disc where it lands and throwing again until they reach the target. For each subsequent shot after the tee shot, the players can alternatively be required to continue using the randomly selected throw and disc, re-roll the dice to determine a new randomly selected throw and disc, or can be permitted to select any throw and disc of their choice. Once each of the players have reached the target, the players proceed to the next hole and the process repeats for each remaining hole of the course. The object of the game is to get through the course with the lowest number of total throws. Play is usually in groups of five or fewer, with each player taking turn at the tee box, then progressing with the player furthest from the hole throwing first, while the other players stand aside. Some courses also include mandatories (also called "Mandos") which require the path of the disc to be above, below or to one side of a specific line indicated by a sign. In this case, the randomly selected throw and/or disc can be ignored if it creates a dangerous condition.

Many variations of the exemplary method, for example but not limited to, only using one of the first and second die 18, 20 for all or some of the holes, allowing each player to select one or more holes for use of the set of dice 16 for another player, himself/herself or all players with the selection(s) being made prior to or during the game, substituting the third die 24 for the first die 18 on one or more holes, and enforcing mis-throws with penalty strokes or laughter. The game does not have to be wild the whole time though, but can permit you to try new shots on holes where you always throw the same thing—a way to mix it up.

It is noted that each of the features of the various disclosed embodiments of the present invention can be utilized in any combination with each of the other disclosed embodiments of the present invention.

From the above disclosure it can be appreciated that the systems and methods according to the presents invention provides a disc golf game with creative shot play during the hundredth play through of your local course. No two games will be the same Additionally, players are forced to use and practice shots that they would otherwise rarely or never use and thus improve their throwing skills.

The embodiments of this invention can be achieved by many techniques and methods known to persons who are skilled in this field. To those skilled and knowledgeable in the arts to which the present invention pertains, many widely differing embodiments will be suggested by the foregoing without departing from the intent and scope of the present invention. The descriptions and disclosures herein are intended solely for purposes of illustration and should not be construed as limiting the scope of the present invention.

What is claimed is:

1. A method for at least one player playing disc golf on a course having a plurality of targets, the method comprising the steps of, in combination:

(a) obtaining a random selection device configured to randomly select one of a plurality of different types of disc throws, and one of a plurality of different types of throwing discs;

(b) the at least one player activating the random selection device to obtain a randomly selected one of the plurality of different types of disc throws, and a randomly selected one of the plurality of different types of throwing discs; and (c) the at least one player throwing the randomly selected one of the plurality of different types of discs with the randomly selected one of the plurality of different disc throws at one of the plurality of targets; and wherein the random selection device is a set of dice including a first die and a second die, wherein the first die and the second die each have a plurality of faces, the plurality of faces of the first die have representations indicating different types of disc throws thereon, wherein the plurality of faces of the second die have representations indicating different types of throwing discs thereon, and wherein the step of activating the at least one selection device comprises the at least one player throwing the set of dice.

2. The method according to claim 1, further comprising the step of repeating steps (b) and (c) until each of the plurality of targets of the course have been completed by the at least one player.

3. The method according to claim 1, further comprising the step of obtaining a plurality of throwing discs including at least one of each of the different types of throwing discs indicated on the second die.

4. The method according to claim 1, wherein the plurality of faces on the first die and the plurality of faces on the second die are each 22 to 26 mm across.

5. The method according to claim 1, wherein the first die and the second die each have at least six faces.

6. The method according to claim 5, wherein the different types of throwing discs include a putter, a mid, and a driver.

7. The method according to claim 6, wherein the different types of throwing discs further include an understable and an overstable.

8. The method according to claim 7, wherein the different types of throwing discs further include a wild selection.

9. The method according to claim 5, wherein the different types of disc throws include a backhand, a forehand, and a roller.

10. The method according to claim 9, wherein the different types of disc throws further include a hyzer and an anhyzer.

11. The method according to claim 10, wherein the different types of disc throws further include a wild selection.

12. The method according to claim 1, wherein the set of dice includes a third die having a plurality of faces that is interchangeable with the first die and the plurality of faces of the third die have representations indicating additional different types of disc throws.

13. A system for playing disc golf comprising, in combination:

a set of dice including a first die and a second die; wherein the first die and the second die each have a plurality of faces;

wherein the plurality of faces of the first die have representations indicating different types of disc throws thereon;

wherein the plurality of faces of the second die have representations indicating different types of throwing discs thereon; and a plurality of throwing discs including at least one of each of the throwing disc types indicated on the second die.

14. The system according to claim 13, wherein the plurality of faces on the first die and the plurality of faces on the second die are each 22 to 26 mm across.

15. The system according to claim 13, wherein the first die and the second die each have at least six faces.

16. The system according to claim 13, wherein at least one of the faces of the first die and at least one of the faces of the second die are wild selections.

17. The system according to claim 13, wherein the set of dice includes a third die having a plurality of faces and the plurality faces of the third die have representations indicating additional different types of disc throws.

* * * * *